US006776145B1

(12) United States Patent
White et al.

(10) Patent No.: US 6,776,145 B1
(45) Date of Patent: Aug. 17, 2004

(54) SUPERCHARGER HAVING PRESSURE AIDED OIL DRAIN

(75) Inventors: David C. White, Dryden, NY (US); Allan C. Harper, Hendersonville, NC (US); Matthew C. Rice, Hendersonville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/464,190

(22) Filed: Jun. 18, 2003

(51) Int. Cl.[7] ..... F02B 33/00
(52) U.S. Cl. ..... 123/559.1
(58) Field of Search ..... 123/559.1, 559.3; 415/122.1

(56) References Cited

U.S. PATENT DOCUMENTS 5,224,459 A 7/1993 Middlebrook ..... 123/559.1
6,192,871 B1 * 2/2001 Middlebrook ..... 123/559.1
6,293,263 B1 9/2001 Middlebrook ..... 123/559.1
6,439,208 B1 * 8/2002 Jones ..... 123/559.1
6,516,789 B1 * 2/2003 Jones ..... 123/559.1
6,615,809 B1 * 9/2003 Martin ..... 123/559.1

* cited by examiner

*Primary Examiner*—Thomas Denion
*Assistant Examiner*—Thai-Ba Trieu
(74) *Attorney, Agent, or Firm*—Brown & Michaels, PC; Greg Dziegielewski

(57) ABSTRACT

A method and apparatus for a supercharger wherein pressurized air originating from the compressor side is fed into its gear box for draining the oil therein due to the reduced size of the gear box. The supercharger includes a gear case encompassing the drive gear and the driven gear. The gear case has at least one oil inlet in the gear case to receive oil, and at least one oil outlet on the gear case. An air passage has a first end connected to the compressor end down stream in relation to the compressor wheel, and a second end connected to the gear box, whereby pressurized air at the compressor end is disposed to be channeled toward the inside of the gear box for draining lubricating fluid therein.

7 Claims, 4 Drawing Sheets

SUPERCHARGER HAVING PRESSURE AIDED OIL DRAIN

FIELD OF THE INVENTION

The invention pertains to the field of supercharger. More particularly, the invention pertains to supercharger having pressure aided oil drain.

BACKGROUND OF THE INVENTION

Superchargers are frequently belt driven and have gears in a gear case to substantially gear up the rotational speed so that the compressor of the supercharger will generate sufficient boost. In presently available superchargers, the space inside the gear case is purposely made relatively large, with much space between the gears and the walls of the gear case so that oil can be flung or spread onto the various gears and bearings therein. However, one side effect of large cases is that larger space is required. This is undesirable in that given the reduced size requirement of some engine design, a more compact form factor is required.

U.S. Pat. No. 6,293,263 to Middlebrook, which is incorporated herein by reference, discloses a compact supercharger having a drive portion, and an atomizer for providing a lubricating oil/air mist to the supercharger. The drive portion has a drive gear with teeth and an outer circumference and a driven gear with teeth and an outer circumference, drive gear bearing races and driven gear bearing races, and a gear case with an inner chamber with a back wall, a front wall, perimeter walls having a swale formed thereon. The drive gear is larger than the driven gear and is positioned below the driven gear. Drive gear bearing mounting recesses receive the drive gear bearing races, and driven gear bearing mounting recesses receive the driven gear bearing races. An oil/air mist inlet is formed in the gear case, and oil/air mist channels are in communication with the oil/air mist inlet and the driven gear bearing races. A splitter with passageways is located near a bottom of the gear case in the vicinity of an oil outlet. The outer circumference of the drive gear is in close proximity to the perimeter walls of the inner chamber and an upper face of the separator portion. During rotation of the drive gear, oil/air mist will be expelled against the perimeter wall portion to aid in separating the air from the oil, the oil will travel down the swale, through the passageways of the splitter, and exit through the oil outlet, thereby preventing windage of the oil in the gear case and assisting in power draining of oil from the gear case.

As can be seen, Middlebrook uses compressor discharge air to atomize incoming oil to create an oil/air mist for lubrication purposes.

Although there has been a substantial amount of development work on more efficient designs for superchargers, there remains a need for improved superchargers that are more compact in design, are better lubricated, and that are more durable, more efficient, and readily installable onto different engines.

SUMMARY OF THE INVENTION

In a centrifugal supercharger that does not have a self contained oiling system, a compact gear box is provided having a pressure aided oil drain.

In a centrifugal supercharger that does not have a self contained oiling system, a compact gear box is provided in that the size of the gear box cavity being more closely approximate the size of the gear set envelope.

In a centrifugal supercharger that does not have a self contained oiling system, pressurized air is introduced into the gear case of the supercharger, wherein the pressurized air is obtained from the discharge side of the compressor housing.

Accordingly, a compact supercharger having a compressor end and a drive portion is provided. The compressor end includes a volute and a compressor wheel. The drive portion includes: a drive gear having an outer circumference and a driven gear having an outer circumference, the drive gear adapted to engage with the driven gear, the driven gear having a driven gear shaft adapted to connect to the compressor wheel, and the drive gear having a drive gear shaft adapted to rotate the drive gear. The compact supercharger includes: a gear case encompassing the drive gear and the driven gear, the gear case having at least one oil inlet in the gear case to receive oil, and at least one oil outlet on the gear case. An air passage is provided which has a first end connected to the compressor end down stream in relation to the compressor wheel, and a second end connected to the gear box, whereby pressurized air at the compressor end is disposed to be channeled toward the inside of the gear box for draining lubricating fluid therein.

In a compact supercharger having a compressor end and a drive portion, the compressor end including a volute and a compressor wheel, the drive portion including: a drive gear having an outer circumference and a driven gear having an outer circumference, the drive gear adapted to engage with the driven gear, the driven gear having a driven gear shaft adapted to connect to the compressor wheel, and the drive gear having a drive gear shaft adapted to rotate the drive gear. A method including the steps of: providing a gear case encompassing the drive gear and the driven gear, the gear case having at least one oil inlet in the gear case to receive oil, and at least one oil outlet on the gear case; providing an air passage having a first end connected to the compressor end down stream in relation to the compressor wheel, and a second end connected to the gear box, whereby pressurized air at the compressor end is disposed to be channeled toward the inside of the gear box for draining lubricating fluid therein; and using pressurized air coming through the air passage to evacuate the gear cavity to a sump of lower pressure.

DESCRIPTION OF THE PREFERRED EMBODIMENT

Centrifugal superchargers that do not have self contained oiling systems typically utilize a pressure feed line and gravity drain. These systems are effective if the drain is free flowing and the internal cavity of the gear case is large to minimize the effects of windage and other oil dynamics caused by the spinning gear set. However, as vehicles are downsized, the reduction of component size becomes increasingly important.

One means to reduce supercharger size is to size the gear box cavity to more closely approximate the size of the gear set envelope. This way, while having the advantage of reduced or compact size, this reduction of volume of the gear box cavity begins to cause drainage problems as the dynamics of the oil flow becomes affected by the proximity of the spinning gears with the walls of the cavity. As a result, the oil within the cavity no longer is able to freely flow into the drain, often causing a back-up of oil within the gear case. These conditions are aggravated at higher engine operating speeds.

Figure 1:
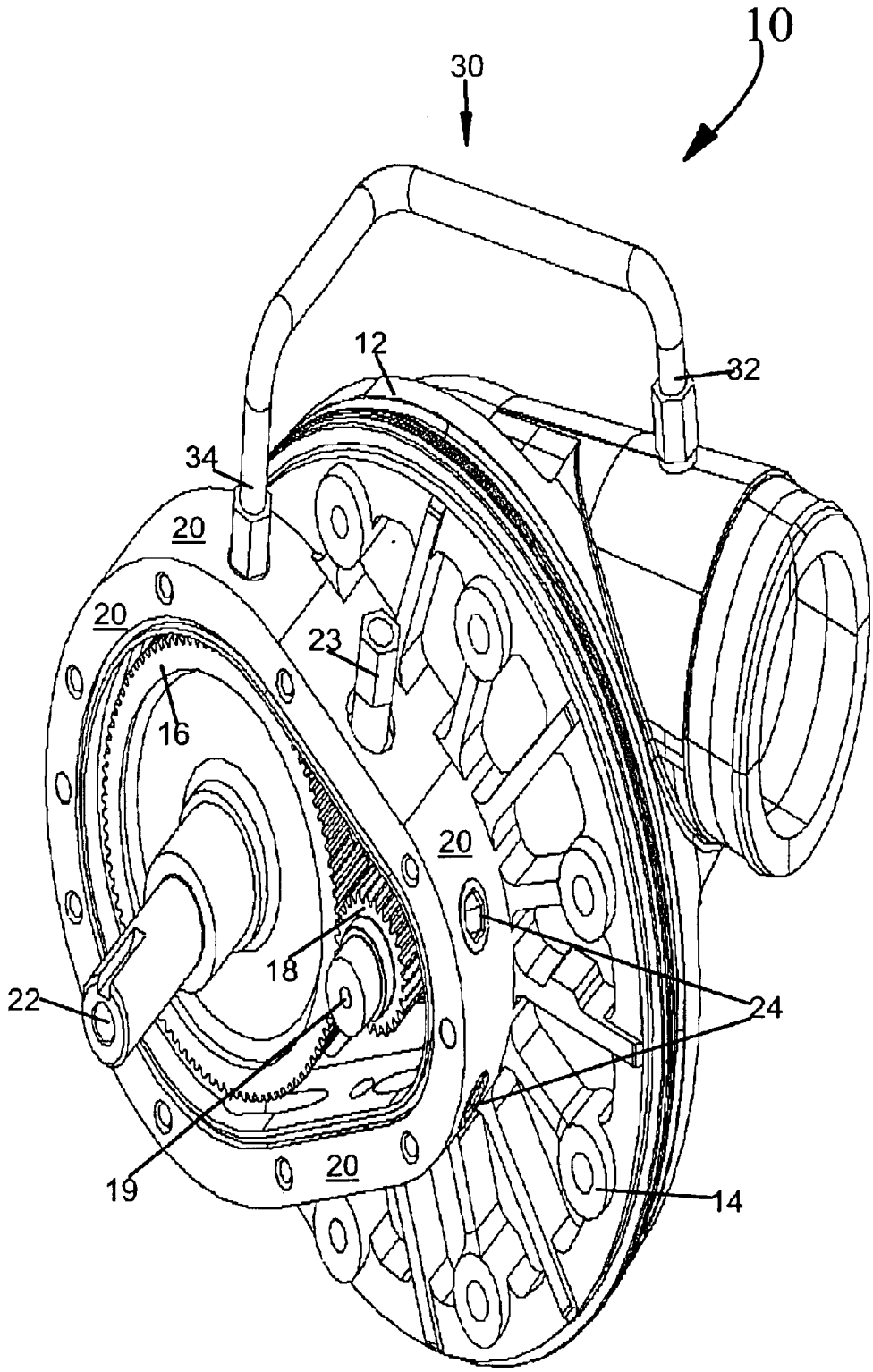
FIG. 1 shows a perspective view of a supercharger of the present invention.
Figure 2:
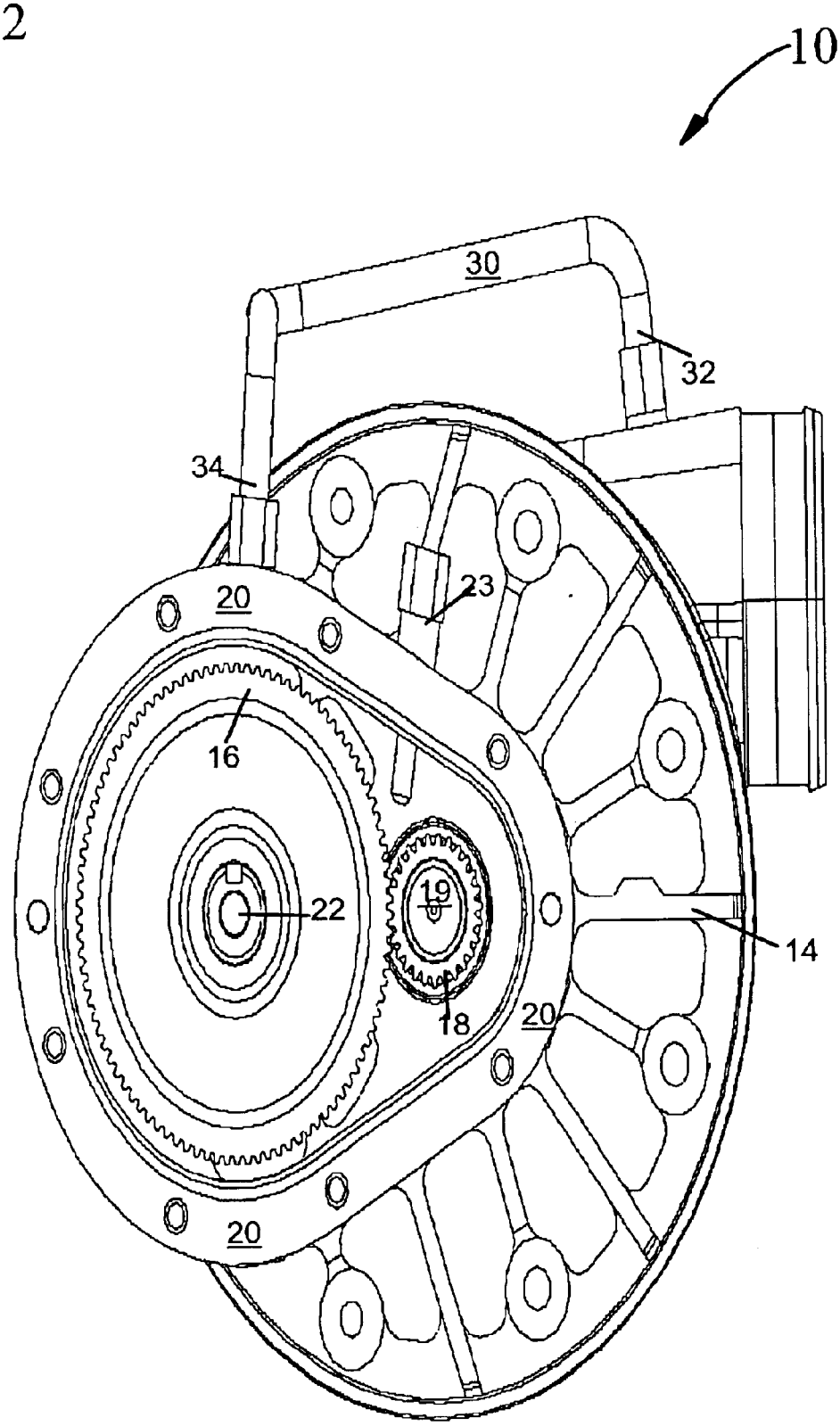
FIG. 2 shows an elevated view of the supercharger of the present invention.
Figure 3:
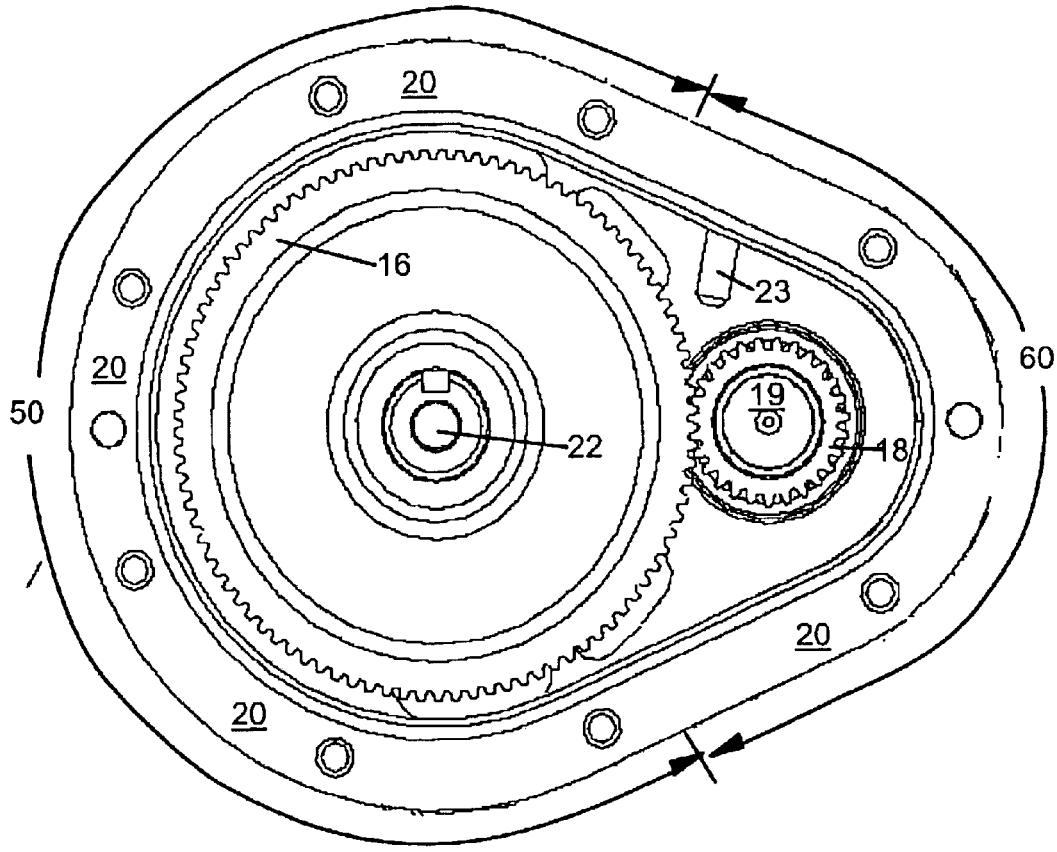
FIG. 3 shows a close up view of FIG. 2.

FIGS. 1–3 show a method and apparatus of the present invention.

Referring to FIGS. 1–3, a perspective view of a compact supercharger 10 of the present invention is shown. The compact supercharger 10 includes a compressor end and a drive portion. The compressor end includes a volute 12 and a compressor wheel 14. The drive portion includes a drive gear 16 having an outer circumference and a driven gear 18 having an outer circumference, the drive gear 16 is adapted to engage with the driven gear 18, the driven gear 18 has a driven gear shaft 19 adapted to connect to the compressor wheel 14, and the drive gear 16 has a drive gear shaft 22 adapted to rotate the drive gear 16.

The compact supercharger 10 includes: a gear case 20 which encompasses the drive gear 16 and the driven gear 18. The gear case 20 has at least one oil inlet 23 in the gear case 20 to receive oil, and at least one oil outlet 24 on the gear case 20 for draining oil therefrom. An air passage 30 is provided that has a first end 32 connected to the compressor end down stream in relation to the compressor wheel 14, and a second end 34 connected to the gear box 20. Whereby pressurized air at the compressor end is channeled toward the inside or the cavity of the gear box 20 for draining lubricating fluid therein. It is noted that the first end 32 can be connected to the down stream compressor end at any location wherein suitable air pressure exists.

As can be appreciated, pressurized air from the compressor end is used to drain the oil within the cavity of the gear box 20. The gear box 20 may be subdivided into two regions, i.e. a first region 50 and a second region 60. First region denotes the location wherein the second end 34 may be located. Second region 60 denotes the location wherein the draining or oil outlet 24 may be located. See FIG. 3. As can be seen, a suitable distance exists between oil outlet 24 and the second end 34 where pressurized air is introduced into the gear box cavity.

Figure 2A:
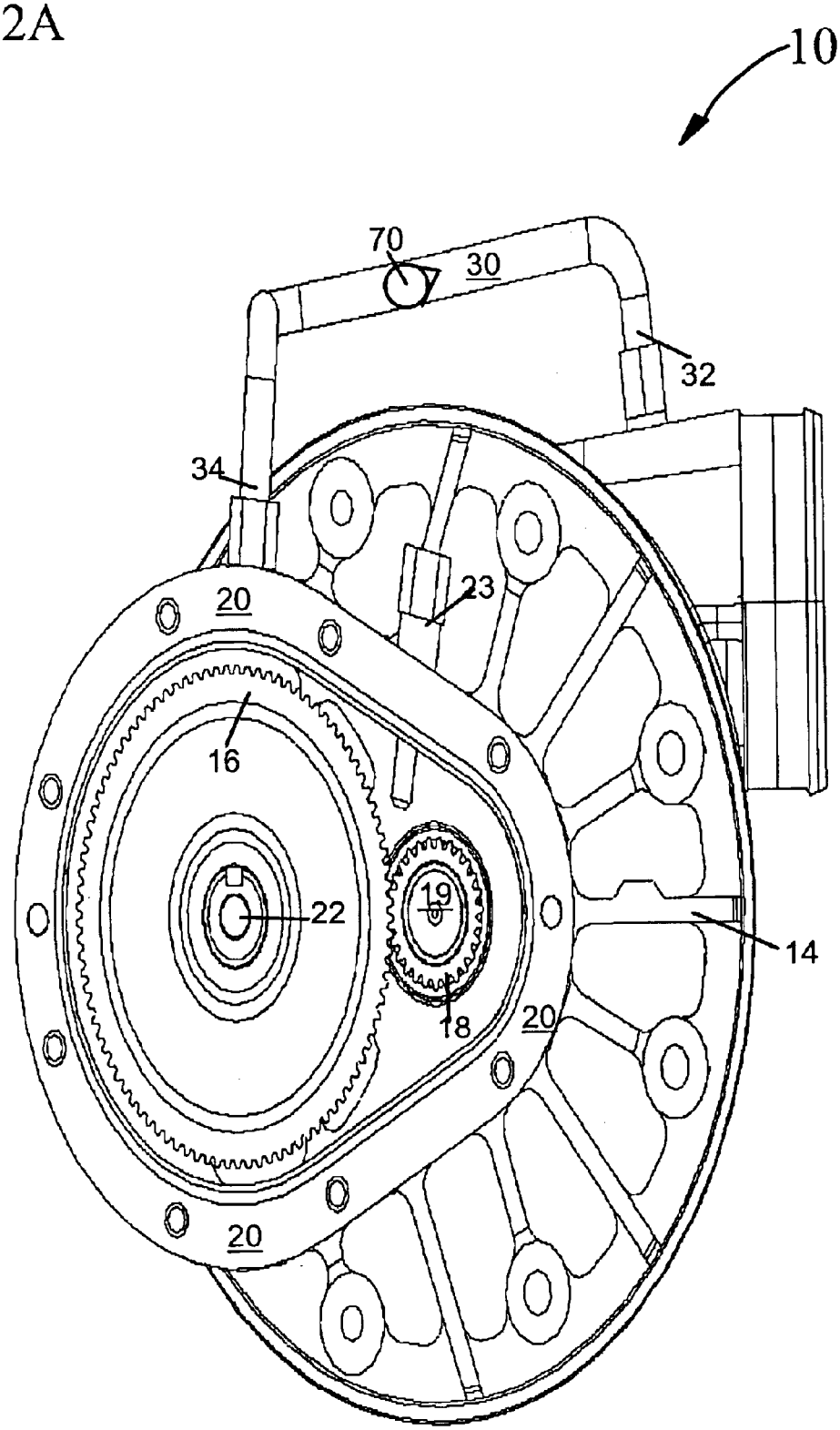
FIG. 2A shows an alternative embodiment of FIG. 2.

Pressure level of air within air passage 30 may sometimes not be suitable for nonimpeded connection. Some type of controller regulating the air flow may be provided. A controller (not shown) that is either of the passive or active type may be provided. For example, a check valve 70 may be interposed between its first end 32 and second end 34. See FIG. 2A.

The supercharger 10 may be placed at a suitable location in relation to the engine block (not shown). Due to its 10 compact size resulting in part from the present invention, there are increased numbers of suitable locations. For example, supercharger 10 may be placed in the middle location of the V type engine block.

As can be seen, the introduction of pressurized air into the gear case 20 has been found to eliminate the issue of slow oil drainage. The pressurized air is obtained from the discharge side of the compressor housing. Check valve 70 may be placed in line so that the pressurized air does not enter the gear cavity at low operating speeds when there are fewer tendencies for the oil to sump in the case 20. As speed, and therefore discharge pressure increases, the check valve will be overcome and pressurized air is allowed to enter the gear cavity. The resultant pressure differential between the gear cavity and the drain sump forces the oil to evacuate the gear cavity to the sump of lower pressure. The pressurized air inlet 23 may also be bled off to limit the amount of pressure that is allowed to build up in the gear cavity.

It is noted that the supercharger of the present invention includes air passage that is comprised of metal duct. Similarly, a method associated with the supercharger uses metal duct as the air passage.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A compact supercharger having a compressor end and a drive portion, the compressor end including a volute and a compressor wheel, the drive portion including: a drive gear having an outer circumference and a driven gear having an outer circumference, the drive gear adapted to engage with the driven gear, the driven gear having a driven gear shaft adapted to connect to the compressor wheel, and the drive gear having a drive gear shaft adapted to rotate the drive gear, the compact supercharger comprising:

a gear case encompassing the drive gear and the driven gear, the gear case having at least one oil inlet in the gear case to receive oil, and at least one oil outlet on the gear case; and an air passage having a first end connected to the compressor end down stream in relation to the compressor wheel, and a second end connected to the gear box, whereby pressurized air at the compressor end is disposed to be channeled toward the inside of the gear box for draining lubricating fluid therein.

2. The supercharger of claim 1, wherein the air passage comprises a metal duct.

3. The supercharger of claim 1, wherein the second end of the air passage is situated in a region at substantial distance relative to the at least one oil outlet on the gear case, thereby facilitating efficient draining of oil.

4. In a compact supercharger having a compressor end and a drive portion, the compressor end including a volute and a compressor wheel, the drive portion including: a drive gear having an outer circumference and a driven gear having an outer circumference, the drive gear adapted to engage with the driven gear, the driven gear having a driven gear shaft adapted to connect to the compressor wheel, and the drive gear having a drive gear shaft adapted to rotate the drive gear, a method comprising the steps of:

providing a gear case encompassing the drive gear and the driven gear, the gear case having at least one oil inlet in the gear case to receive oil, and at least one oil outlet on the gear case;

providing an air passage having a first end connected to the compressor end down stream in relation to the compressor wheel, and a second end connected to the gear box, whereby pressurized air at the compressor end is disposed to be channeled toward the inside of the gear box for draining lubricating fluid therein; and using pressurized air coming through the air passage to evacuate the gear cavity to a sump of lower pressure.

5. The method of claim 4 further comprising limiting the pressurized air flow within the air passage.

6. The method of claim 4, wherein the air passage comprises a metal duct.

7. The method of claim 4, wherein the second end of the air passage is situated in a region at substantial distance relative to the at least one oil outlet on the gear case, thereby facilitating efficient draining of oil.

* * * * *